US008379493B2

(12) United States Patent
Mertenat

(10) Patent No.: US 8,379,493 B2
(45) Date of Patent: Feb. 19, 2013

(54) SPRING LOADED DRIVING MEMBER FOR TIMEPIECE MOVEMENT

(75) Inventor: Olivier Mertenat, Solothurn (CH)

(73) Assignee: Montres Jaquet Droz SA, La Chaux-de-Fonds (CH)

( * ) Notice: Subject to any disclaimer, the term of this patent is extended or adjusted under 35 U.S.C. 154(b) by 383 days.

(21) Appl. No.: 12/743,213

(22) PCT Filed: Oct. 8, 2008

(86) PCT No.: PCT/EP2008/063419

§ 371 (c)(1),
(2), (4) Date: May 14, 2010

(87) PCT Pub. No.: WO2009/062792

PCT Pub. Date: May 22, 2009

(65) Prior Publication Data

US 2010/0246339 A1 Sep. 30, 2010

(30) Foreign Application Priority Data

Nov. 16, 2007 (EP) ..... 07120872

(51) Int. Cl.
*G04B 1/10* (2006.01)

(52) U.S. Cl. ..... 368/203; 368/140

(58) Field of Classification Search ..... 368/140–144, 368/203

See application file for complete search history.

(56) References Cited

U.S. PATENT DOCUMENTS

| | | | | | |
|---|---|---|---|---|---|
| 410,327 | A * | 9/1889 | Meylan | ..... | 368/142 |
| 711,476 | A * | 10/1902 | Corey | ..... | 368/143 |
| 1,392,676 | A * | 10/1921 | Borresen | ..... | 368/142 |
| 4,362,553 | A * | 12/1982 | Ray et al. | ..... | 75/352 |
| 7,452,123 | B2 * | 11/2008 | Girardin et al. | ..... | 368/140 |
| 8,182,138 | B2 * | 5/2012 | Jolidon | ..... | 368/101 |
| 2007/0091728 | A1 * | 4/2007 | Girardin et al. | ..... | 368/142 |
| 2010/0002548 | A1 * | 1/2010 | Hessler et al. | ..... | 368/129 |
| 2011/0222376 | A1 * | 9/2011 | Musy et al. | ..... | 368/140 |

FOREIGN PATENT DOCUMENTS

| | | | |
|---|---|---|---|
| CH | 49 154 A | | 1/1911 |
| EP | 1115040 | * | 7/2001 |
| FR | 71 490 E | | 1/1960 |

OTHER PUBLICATIONS

EP 1657604 Mueller—Drawings only; 2006.*

CH 610465 Montres—Drawings only; 1979.*

International Search Report issued in corresponding application No. PCT/EP2008/063419, completed Nov. 27, 2008 and mailed Dec. 4, 2012.

* cited by examiner

*Primary Examiner* — Sean Kayes

(74) *Attorney, Agent, or Firm* — Griffin & Szipl, P.C.

(57) ABSTRACT

A driving member for a timepiece movement comprises two superimposed coaxial barrels (1, 11) coupled in series, each barrel including a spring provided in a cylindrical housing rotatingly mounted on a common shaft (20). The respective housings (2, 12) of the barrels are positioned opposite each other and do not include a lid, and the springs (7, 17) are separated only by a separation washer (26) or a gap. This arrangement can be used for increasing the height (H) of the springs, and thereby the amount of energy and the power reserve of the watch for an identical global volume of the driving member, or for reducing the total height of the driving member. Such a driving member is particularly intended for watches with a high power reserve.

8 Claims, 1 Drawing Sheet

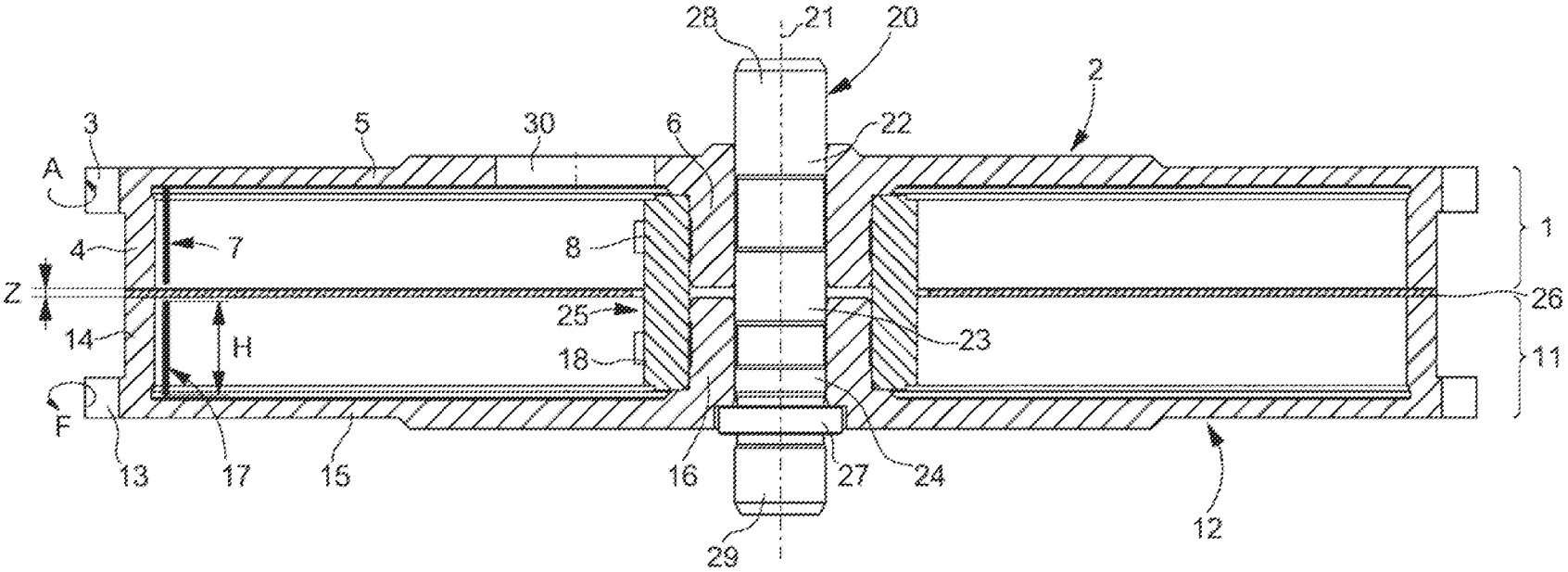
1
26
11
12
2
23
24
20
22
27
21
28
29
6
16
8
25
18
30
5
15
7
H
17
3
4
14
13
A
F
Z

SPRING LOADED DRIVING MEMBER FOR TIMEPIECE MOVEMENT

This is a National Phase Application in the United States of America of International Patent Application PCT/EP 2008/065347 filed Nov. 12, 2008, which claims priority on European Patent Application No. 07120883.9 of Nov. 16, 2007. The entire disclosures of the above patent applications are hereby incorporated by reference.

BACKGROUND OF THE INVENTION

The present invention relates to a spring-loaded driving member for a timepiece movement comprising two coaxial barrels coupled in series, each barrel having a rotatable cylindrical housing provided with an outer tooth arrangement and a base, and a spring rolled up inside the housing and having an outer end coupled to the housing and an inner end coupled to a core, wherein the respective cores of the barrels are interdependently rotatable and the respective bases of the barrels are located axially opposite one another. In other words, the two barrels are superposed and face one another, an arrangement that is represented in particular in patent applications EP 1 115 040 (with two groups of two barrels) and EP 1 657 604.

In the field of mechanical watch movements it is well known to replace the usual driving member comprising a single barrel fitted with a spring by a group of two barrels coupled in series in order to store a sufficiently large amount of potential energy to assure a power reserve greater than the usual 40 hours or so without having an effect on the chronometric performances of the watch or the efficiency of the mechanism. A detailed explanation of the functional characteristics of such a driving member may be found in the Swiss patent CH 610 465 which provides a superposed arrangement and a side-by-side arrangement of the barrels as examples. In the present case, it is the superposed arrangement that is selected because the moment can be transmitted from one barrel to the other directly via a common shaft, which prevents losses of space and efficiency as a result of the transmission gearing that is necessary in the side-by-side arrangement.

However, the coaxial and superposed arrangement of the usual barrels, as may be seen in the abovementioned patents, results in the driving arrangement having a relatively large space requirement in axial direction, i.e. in the direction perpendicular to the main bottom plate of the timepiece movement. In fact, the total height of the device is not only made up of twice the respective heights of the base, spring, cover and internal clearance of each barrel, but additionally a minimum gap between the two covers that face one another and must not touch one another, since they rotate at different speeds. Consequently, the total height of an arrangement with superposed barrels always gives rise to a relatively large thickness of the watch movement and this constitutes a disadvantage in most cases. Since the number of expansion turns of a barrel spring cannot be increased without reducing its efficiency, if the manufacturer wishes to reduce the height of the barrels and therefore of the springs, he automatically reduces the energy that can be stored and thus also the power reserve of the watch.

SUMMARY OF THE INVENTION

The present invention relates to a driving member with two coaxial superposed barrels that is improved so that it can store more energy than a classic member of this type of the same height, or it can have a reduced height using the same springs for the same energy storage capacity. An additional aim is to achieve this with a simple construction, easy assembly and with a small number of parts.

A driving member of the type defined in the above introduction and characterised in that the two barrels do not have a cover, their springs only being separated from one another by a separation washer or by a gap, is provided for this.

Therefore, the essential improvement achieved by the invention lies in the possibility of omitting the two covers arranged to face one another and separated by a gap, as seen in particular in the above-mentioned patents EP 1 115 040 and EP 1 657 604. These omitted elements are preferably replaced by a simple separation washer, the purpose of which in particular is to prevent the turns of the two springs from crossing one another when the springs are relaxed. This washer can be very thin and formed from a sheet of an antifriction material such as PTFE, for example. The two springs can thus be brought as close as possible to one another axially and the housings of the barrels can be provided with a height that is close to that of the springs. The washer of antifriction material can advantageously extend between the respective cylindrical parts of the housings that can thus be brought as close to one another as possible. These arrangements both allow the total height of the driving member to be reduced while retaining the dimensions of the springs according to the prior art and the height of the springs, and therefore the amount of energy and the power reserve, to be increased with the same total volume of the driving member. Moreover, the number of parts of the device is reduced by one or more units in relation to the designs according to the prior art.

However, an alternative design consists of replacing the separation washer with an adequate gap to prevent contact between the two springs in normal operating conditions of the watch.

It can in fact be accepted that the springs can briefly touch one another in some circumstances, e.g. in the case of impact on the watch, since the effect on operation of the watch remains insignificant. If the springs touch one another when relaxed, any effect on the operation of the watch can be ignored since the movement has stopped or is about to stop.

In accordance, then, with a first non-limiting illustrative embodiment of the present invention, a spring-loaded driving member is provided for a timepiece movement comprising two coaxial barrels (1, 11) coupled in series, each barrel having a rotatable cylindrical housing (2, 12) provided with an outer tooth arrangement (3, 13) and a base (5, 15), and a spring (7, 17) rolled up inside the housing and having an outer end coupled to the housing and an inner end coupled to a core (8, 18), wherein the respective cores of the barrels are interdependently rotatable and the respective bases (5, 15) of the barrels are located axially opposite one another, and characterised in that the two barrels (1, 11) do not have a cover, their springs (7, 17) only being separated from one another by a separation washer (26) or by a gap, that each housing (2, 12) has a substantially cylindrical central hub (6, 16), in which a shaft (20) common to both barrels is housed, wherein at least one of the housings is rotatably mounted on the common shaft (20), and in that the two cores (8, 18) form part of a common tubular element (25) mounted to be rotatable around the two hubs (6, 16) of the housings. In accordance with a second non-limiting illustrative embodiment of the invention, the first illustrative embodiment is modified so that the separation washer (26) is formed from a sheet of an antifriction material. In accordance with a third non-limiting illustrative embodiment of the present invention, the second illustrative embodiment is modified so that the separation washer (26) extends between the respective cylindrical outer parts (4, 4) of the housings.

In accordance with a fourth non-limiting illustrative embodiment of the present invention, the first illustrative embodiment is modified so that the two housings (2, 12) are rotatably mounted on the common shaft (20). In accordance with a fifth non-limiting illustrative embodiment of the present invention, the first illustrative embodiment is modified so that the separation washer (26) is mounted to be rotatable around the common tubular element (25). In accordance with a sixth non-limiting illustrative embodiment of the present invention, the first illustrative embodiment is modified so that the width of the gap is defined by a common tubular element (25), which is supported on the two rotatable cylindrical housings (2, 12).

Other features and advantages of the invention will become evident from the following description of a preferred embodiment presented simply by way of example and illustrated by the attached drawing.

BRIEF DESCRIPTION OF THE DRAWING

The single FIGURE of the drawing is a schematic view in axial section of a driving member for a watch movement comprising two coaxial barrels of the same size arranged so that their housings and their respective springs face one another and are only separated by a thin separation washer.

DETAILED DESCRIPTION OF AN EMBODIMENT

The driving member shown in the drawing comprises a first barrel 1 and a second barrel 11, which are superposed and mounted on a common shaft 20 to rotate independently of one another around the axis 21 of the shaft. The first barrel 1 has a cylindrical housing 2 having an outer tooth arrangement 3, a cylindrical outer drum 4, a base 5 and a wide cylindrical central hub 6 rotatably mounted on bearing surfaces 22 and 23 of the shaft 20. The housing 2 contains a driving spring 7 rolled up in a spiral, of which only a single turn is shown for clarity of the drawing. The outer end of the spring 7 is coupled to the drum 4 by a slip spring device, while its inner end is fastened to a core 8 mounted to be rotatable around the hub 6.

The structure of the second barrel 11 is the same as that of the first, having a housing 12 with a tooth arrangement 13, a drum 14, a base 15 and a hub 16 rotatably mounted on bearing surfaces 23 and 24 of the common shaft 20. The bearing surfaces 22, 23 and 24 are separated by parts with a slightly reduced diameter referred to as spools, which facilitate the alignment of parts and lubrication. The spring 17 of the second barrel has the same dimensions and features as the spring 7, except that it is rolled in the opposite direction and is secured to the drum 14 without a slip spring. Its inner end is fastened to a core 18 in one piece with the core 8, wherein these two cores are formed by a single tubular element 25, which rotates around the two cores 6 and 16 and is supported against the bases 5 and 15 to retain a small axial gap Z between the two housings 2 and 12 and also between the two springs. Positioned in this gap is a thin separation washer 26, which has an outside diameter substantially equal to that of the drums 4 and 14, which hold it between them in axial direction, while allowing the washer to still rotate freely. The edge of the central hole of the washer 26 surrounds the tubular element 25 with slight radial play, which holds the washer in radial direction. The washer can be easily formed by cutting it out of a sheet of synthetic material with a low coefficient of friction, e.g. PTFE. However, if it is desirable for the washer to be more rigid, this can be made from metal, possibly with an antifriction covering.

The shaft 20 can be jointly rotatable with one of the barrel housings, its ends 28 and 29 then being mounted in the usual manner, by virtue of the stones, in the bottom plate and the barrel bridge. This costly assembly is not necessary with the design described here, since the shaft 20 does not need to turn, because it rotatably bears the two housings 2 and 12 and the tubular element 25, while supporting them axially by means of a flange 27. The end 29 of the shaft can simply be inserted into a hole in the bottom plate. A circlip (not shown) can be provided above the bearing surface 22 of the shaft to axially hold the upper housing 2 when this function is not assured by the barrel bridge. When viewing the drawing, a person skilled in the art will see that assembly of the double-barrel driving member does not pose any particular difficulty, since slots 30 are provided in the base 5 of the upper housing to allow the spring 7 to be hooked onto and unhooked from the core 8 after assembly of this housing.

The operation of the driving member is similar to that described in patent application EP 1 657 604, to which the reader can refer for more details. A winding mechanism, in particular a self-winding arrangement indicated by the arrow A in the drawing, is meshed to the tooth arrangement 3 of the first barrel to cause it to rotate in order to activate the springs and prevent it from turning in the opposite direction because of a catch incorporated into the mechanism. The tubular element 25 transmits the moment of the first spring 7 to the second spring 17 so that the degree of activation of the two springs is always the same. This moment is re-transmitted by the tooth arrangement 13 of the second barrel to a classic movement mechanism, represented by the arrow F, through which the escapement of the timepiece movement determines the rotational speed of the second housing 12. The rotational speed of the tubular element 25 is clearly equal to the mean of those of the housings 2 and 12.

If the attached drawing is compared to the prior art illustrated by the figures of the abovementioned European patent applications, it is clearly evident that the present invention allows the height H of each of the two springs 7 and 17 to be substantially increased with the same total height of the two-barrel driving member. In a specific example it was possible to thus change the height of each spring from 0.82 to 1.12 mm without changing the volume of the driving member, which represents an increase of 28% with respect to the specific energy (in J/cm$^3$) stored in the device. Moreover, the total number of parts is reduced and the production of the central shaft 20 without a core is simpler. Finally, the omission of the usual two covers simplifies both the production of the barrel housings and the assembly of the driving member.

The invention claimed is:

1. A spring-loaded driving member for a timepiece movement, comprising:

(a) two coaxial barrels coupled in series, wherein each barrel has a rotatable cylindrical housing provided with an outer tooth arrangement and a base, and a spring rolled up inside the housing and having an outer end coupled to the housing and an inner end coupled to a core, wherein the respective cores of the barrels are interdependently rotatable and the respective bases of the barrels are located axially opposite one another, wherein the two barrels do not have a cover, and the respective springs of the two barrels are only separated from one another by a separation washer, and each housing has a substantially cylindrical central hub, in which a shaft common to both of the two barrels is housed, wherein at least one of the housings is rotatably mounted on the common shaft, and the two cores form part of a common tubular element mounted rotatably around the two central hubs of the two housings.

2. The driving member according to claim 1, wherein the separation washer is formed from a sheet of an antifriction material.

3. The driving member according to claim 2, wherein the separation washer extends between the respective cylindrical outer parts of the housings.

4. The driving member according to claim 1, wherein both of the two housings are rotatably mounted on the common shaft.

5. The driving member according to claim 1, wherein the separation washer is mounted rotabably around the common tubular element.

6. A spring-loaded driving member for a timepiece movement, comprising:

(a) two coaxial barrels coupled in series, wherein each barrel has a rotatable cylindrical housing provided with an outer tooth arrangement and a base, and a spring rolled up inside the housing and having an outer end coupled to the housing and an inner end coupled to a core, wherein the respective cores of the barrels are interdependently rotatable and the respective bases of the barrels are located axially opposite one another, wherein the two barrels do not have a cover, and the respective springs of the two barrels are only separated from one another by a gap, and each housing has a substantially cylindrical central hub in which a shaft common to both of the two barrels is housed, wherein at least one of the housings is rotatably mounted on the common shaft, and the two cores form part of a common tubular element mounted rotatably around the two central hubs of the two housings.

7. The driving member according to claim 6, wherein both of the two housings are rotatably mounted on the common shaft.

8. The driving member according to claim 6, wherein a width of the gap is defined by a common tubular element that is supported on the two rotatable cylindrical housings.

* * * * *